US008991550B2

(12) United States Patent
Coley

(10) Patent No.: US 8,991,550 B2
(45) Date of Patent: Mar. 31, 2015

(54) BAFFLE FOR USE IN A SOUND SUPPRESSOR FOR A FIREARM

(71) Applicant: M-TAC Precision, LLC, Rocky Mount, NC (US)

(72) Inventor: Michael Coley, Spring Hope, NC (US)

(73) Assignee: M-TAC Precision, LLC, Rocky Mount, NC (US)

( * ) Notice: Subject to any disclaimer, the term of this patent is extended or adjusted under 35 U.S.C. 154(b) by 0 days.

(21) Appl. No.: 13/961,600

(22) Filed: Aug. 7, 2013

(65) Prior Publication Data

US 2015/0041246 A1 Feb. 12, 2015

(51) Int. Cl.
*F41A 21/30* (2006.01)

(52) U.S. Cl.
CPC ..... *F41A 21/30* (2013.01)
USPC ..... 181/223; 89/14.4

(58) Field of Classification Search
CPC ..... F41A 21/30
USPC ..... 181/223; 89/14.4
See application file for complete search history.

(56) References Cited

U.S. PATENT DOCUMENTS

| | | | | |
|---|---|---|---|---|
| 2,609,886 | A | 9/1952 | Harmon | |
| 4,588,043 | A * | 5/1986 | Finn | 181/223 |
| 5,029,512 | A | 7/1991 | Latka | |
| 5,164,535 | A | 11/1992 | Leasure | |
| 6,374,718 | B1 | 4/2002 | Rescigno et al. | |
| 6,575,074 | B1 | 6/2003 | Gaddini | |
| 7,237,467 | B1 | 7/2007 | Melton | |
| 7,308,967 | B1 | 12/2007 | Hoel | |
| 7,600,606 | B2 | 10/2009 | Brittingham | |
| 7,931,118 | B1 | 4/2011 | Cronhelm | |
| 7,987,944 | B1 | 8/2011 | Brittingham et al. | |
| 8,096,222 | B2 * | 1/2012 | Silvers | 89/14.4 |
| 8,100,224 | B1 | 1/2012 | Olson | |
| 2012/0152649 | A1 | 6/2012 | Larue | |

OTHER PUBLICATIONS

K-Baffle. Product description, one page. Silencer-Plans. com. Viewed online at http://www.silencer-plans.com/english_files/KBaffle.htm on Apr. 25, 2013.

"Model TAC 65." Tactical Innovations Inc., Bonners Ferry, ID. Source: http://www.oxford-armory.com/tac65.php. Aug. 2011.

* cited by examiner

*Primary Examiner* — Jeremy Luks
(74) *Attorney, Agent, or Firm* — Coats & Bennett, P.L.L.C.

(57) ABSTRACT

A baffle for use in a sound suppressor that is designed to minimize the sound that emanates from a fired firearm. The baffle generally includes a back section and a conical section. A bore extends through each of the sections and is sized for a fired projectile to pass through. The sides of one or both of the sections are configured to reduce the sound. Further, a second hole extends through the back section at the bore to allow for the passage of gases.

14 Claims, 6 Drawing Sheets

BAFFLE FOR USE IN A SOUND SUPPRESSOR FOR A FIREARM

BACKGROUND

The present application is directed to a baffle for use in a suppressor for a firearm and, more specifically, to a baffle with a stepped design.

Suppressors are devices that attach to the barrel of a firearm to reduce the amount of noise and amount of muzzle flash that occurs when the firearm is fired. Sound suppressors normally include a metal tube with a number of interior baffles that form expansion chambers. The suppressor is designed to divert the rapidly expanding gases that are expelled from the end of the firearm into the expansion chambers. The trapped gases expand and cool and the pressure and velocity decreases as it moves through and exits the suppressor.

Existing suppressors use a variety of different constructions in attempts to reduce the amount of noise that occurs during firing of the firearm. These may include a wide variety of baffle configurations, lengths and sizes of the metal tube, and attachment mechanisms for attached to the end of the firearm.

Existing suppressors are often not adequate to reduce the sound that emanates from a fired firearm. This results in the level of sound that emanates from the firearm remaining too high for use by the shooter. Existing suppressors may also include intricate and/or extensive internal mechanisms positioned within the interior of the metal tube. These internal mechanisms are designed to reduce the sound. However, these mechanisms often result in excessive costs for the suppressor. The mechanisms may also be unacceptably heavy or bulky thus lessening the effectiveness of the firearm. Each of these various drawbacks may result in the shooter not using the suppressor or reluctantly using the suppressor.

Therefore, there is a need for a suppressor that is effective in reducing the sound and muzzle flash that emanates from the firearm.

SUMMARY

The present application is directed to a baffle for use in a sound suppressor for a firearm.

One embodiment is directed to a baffle that includes a back section with a first side configured to face towards the firearm and an opposing second side, and a conical section that extends outward at the second side of the back section and includes an outer side and an inner side. The conical section includes a tapered shape that enlarges away from the back section. An opening extends through the back section and has an inlet at the first side and an outlet at the second side. A central bore extends through the back section and the conical section. Steps extend around the outer side of the conical section and along a length of the outer section. The steps face the outlet of the opening and each of the steps includes a flat riser section that extends away from the central bore, a flat tread section, and a curved intermediate portion that connects the riser and tread sections.

In the baffle, the riser section may be perpendicular with the central bore.

The tread section may be parallel with the central bore.

The baffle may include a single opening that extends through the back section.

The opening may intersect with the central bore within an interior of the back section between the first and second sides.

The first side of the back section may include a concave indent that extends around the central bore.

The baffle may also include a second series of steps that extend around and along the inner side of the conical section. Each of the second series of steps may include a riser section and a tread section.

Each of the steps of the baffle may include a common shape and size.

Another embodiment is directed to a baffle that includes a central bore, and a conical section that includes an inner side that faces towards the central bore and an outer side that faces away from the central bore. The conical section has a tapered shape with a first axial end having a smaller outer diameter than a second axial end. Steps extend along each the inner and outer sides of the conical section with each of the steps including a riser section that extends away from the central bore, a tread section, and an intermediate portion that connects the riser and tread sections. The intermediate portion has a constant radius.

The baffle may include that each of the intermediate portions of the steps is aligned along a straight line that is positioned at an acute angle relative to the central bore.

Each of the tread sections and the riser sections may be flat.

Each step may include the tread section and the riser section being aligned at a 90° angle.

The riser section may be perpendicular with the central bore.

Each of the steps may include a common shape and size.

Another embodiment is directed to a baffle that includes a central bore, a back section that extends around the central bore with a first side configured to face towards the firearm and an opposing second side, and a conical section that extends around the central bore and is integral with and extends outward from the back section along the central bore. The conical section includes an inner side that faces towards the central bore and an outer side that faces away from the central bore. The conical section has a tapered shape that enlarges away from the back section. An opening extends through the back section with an inlet at the first side that is in communication with the central bore and an outlet at the second side. A centerline of the opening is parallel with the tapered conical section. Steps extend along each the inner and outer sides of the conical section with each including a riser section that extends away from the central bore, a tread section, and an intermediate portion that connects the riser and tread sections.

The intermediate section of each step along the outer side may include a constant radius.

The riser section of each step may be perpendicular with the central bore.

The tread section of each step may be parallel with the central bore.

Each of the steps along the outer side may include a common shape and size.

The first side of the back section may include a concave indent that extends around the central bore.

These various aspects may be used together in a single procedure. Alternatively, the various aspects may be used separately to include just the use of the subsequent middle region reaming, and just the use of the dummy implant.

DETAILED DESCRIPTION

The present application is directed to a baffle for use in a sound suppressor. The baffle is designed to minimize the sound that emanates from a fired firearm. The baffle generally includes a back section and a conical section. A bore extends through each of the sections and is sized for a fired projectile to pass through. The sides of one or both of the sections are configured to reduce the sound. Further, a second hole extends through the back section at the bore to allow for the passage of gases.

Figure 1:
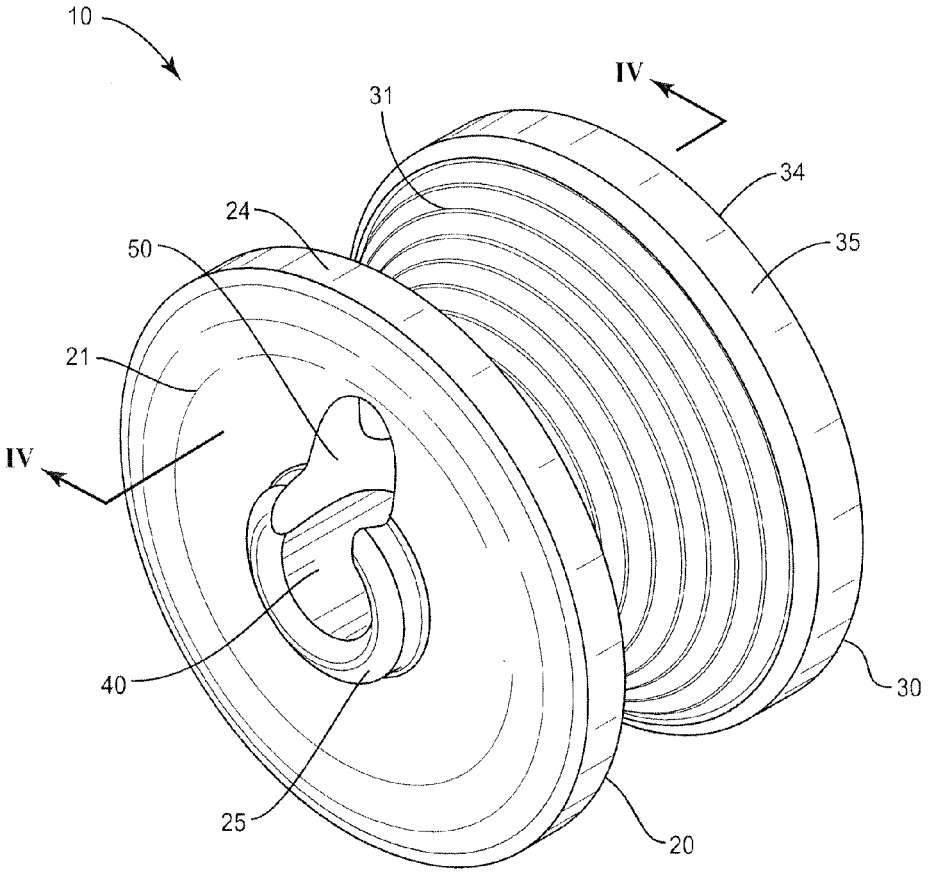
FIG. 1 is a front perspective view of a baffle for use in a sound suppressor for a firearm.
Figure 2:
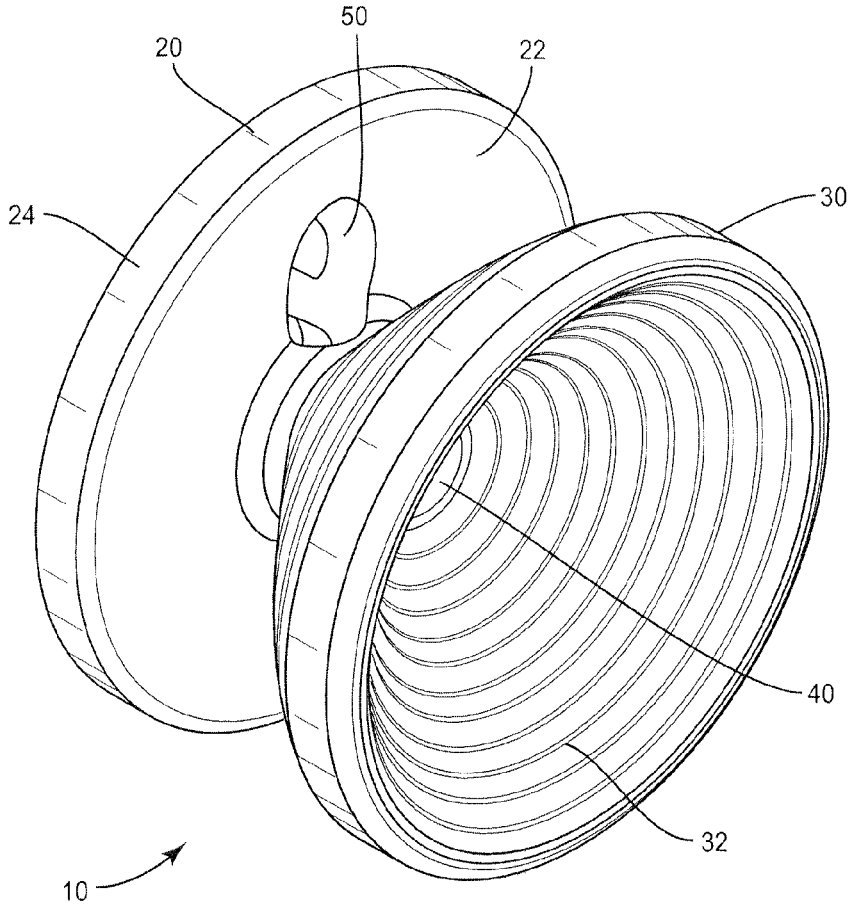
FIG. 2 is a back perspective view of a baffle for use in a sound suppressor for a firearm.

FIGS. 1 and 2 illustrate a baffle 10 that includes a back section 20 and a conical section 30. The sections 20, 30 may be formed as a unitary, single piece, or may be constructed from separate pieces that are attached together. A cylindrical bore 40 extends along a centerline C of the baffle 10 and through the center of each section 20, 30. The bore 40 is sized to allow passage of the fired projectile. An opening 50 extends through the back section 20 at the bore 40 to allow the passage of gases. The baffle 10 is designed to be positioned within a tube of a sound suppressor with the back section 20 facing towards the firearm and the conical section 30 facing away from the firearm. The surfaces of the sections 20, 30 are configured to reduce the noise caused by the fired projectile.

The back section 20 includes a first side 21 that faces away from the conical section 30, and a second side 22 that faces towards the conical section 30. An outer edge 24 extends between the sides 21, 22 and is substantially flat. The thickness of the outer edge 24 measured between the first and second sides 21, 22 may vary. One embodiment includes a thickness of 0.1875 inches. The back section 20 includes a circular shape when viewed axially along the centerline C and is designed to fit within a tube of the suppressor with the outer edge 24 contacting against an inner side of the tube as will be explained in detail below.

Figure 4:
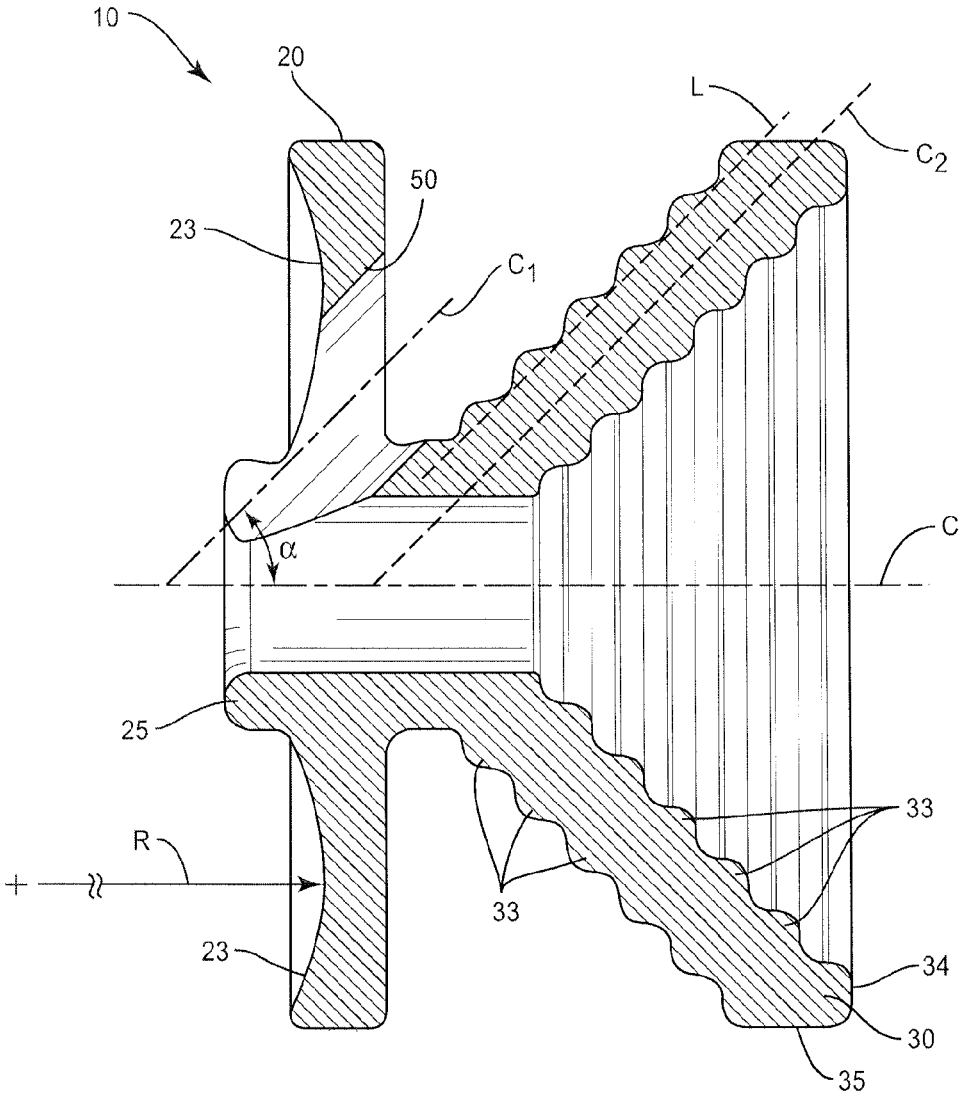
FIG. 4 is a sectional view cut along line IV-IV of FIG. 1.

The first side 21 includes a concave indent 23 that extends around the central bore 40. The concave indent may include a continuous curve, and may be uniform around the central bore 40. In one embodiment as illustrated in FIG. 4, the concave indent 23 includes a radius R of 0.5625 inches. In one embodiment, the maximum depth measured inward from the first side 21 is positioned at a center point between the central bore 40 and the outer edge 24.

Figure 3:
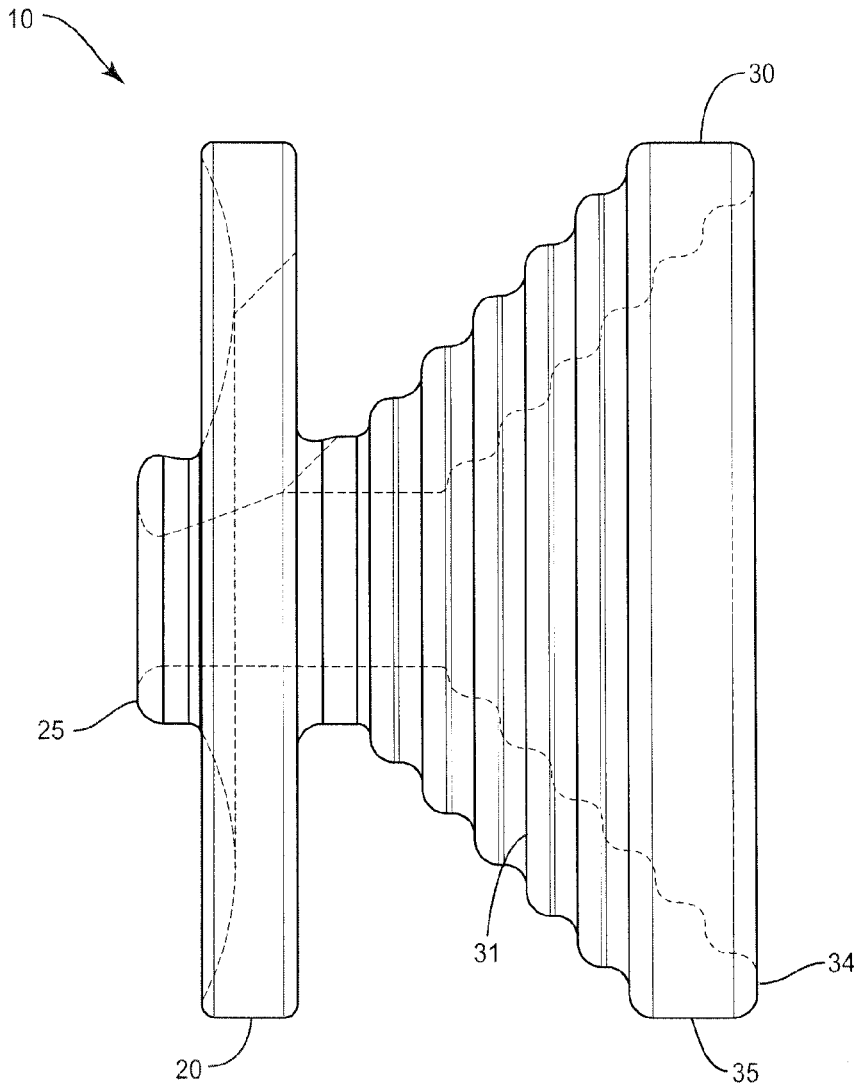
FIG. 3 is a side schematic view of a baffle.

The first side 21 also includes a neck 25 that extends axially outward along the bore 40. In one embodiment, the neck 25 includes a length along the bore 40 of 0.10 inches. As illustrated in FIGS. 3 and 4, the neck 25 extends outward along the bore 40 beyond the first side 21 of the back section 20. The neck 25 includes a thickness measured radially outward from the bore 40. The neck 25 includes a thickness measured radially from the bore 40. In one embodiment, the thickness of the neck 25 is 0.2225 inches.

The opening 50 extends through the back section 20 and provides for gases that are emitted from the firearm to pass to the conical section 30. The opening 50 may include a variety of cross-sectional shapes with one embodiment including a circular shape about a centerline C1. The opening 50 intersects with the bore 40 within the interior of the back section 20. When viewed from the front, the combined bore 40 and opening 50 form an elongated shape along the back section 20.

As illustrated in FIG. 4, the opening 50 includes a centerline C1 that forms an acute angle $\alpha$ with the centerline C of the bore 40. The angle $\alpha$ may vary with embodiments falling within a range of between 30° to 60°, with one specific embodiment including an angle $\alpha$ of 45°. In one embodiment as illustrated in FIG. 4, the centerline C1 intersects the centerline C at a point outward from the neck 25 (i.e., in front of the neck 25).

The opening 50 is configured to direct the gases from the firearm against the conical section 30. The opening 50 may be parallel with the conical section 30. This provides for the gases to move across the outer surface of the conical section 30. In one embodiment, the centerline C1 of the opening 50 is parallel with a centerline C2 that extends through the body of the conical section 30. In another embodiment, the centerline C1 is parallel with a line L that extends along the valleys of ridges along the conical section 30. The centerline C1 may also be parallel with other lines that extend through various sections of the body of the conical section, including the peaks of the ridges, or a center of the ridges.

The second side 22 of the back section 20 faces towards the conical section 30. In one embodiment, the second side 22 is flat.

The conical section 30 extends outward from the back section 20 and is centered around the bore 40. In one embodiment, the conical section 30 includes an outwardly tapered shape that enlarges away from the back section 20. The conical section 30 includes a first side 31 that faces outward away from the bore 40 and a second side 32 that faces inward towards the bore 40. The end 34 of the conical section 30 is open and faces away from the back section 20.

A band 35 extends around the end 34 at the first side 31. The band 35 is configured to contact against the inner side of the suppressor tube. In one embodiment as illustrated in FIG. 3, the length of the band 35 is 0.25 inches. The band 35 may include a circular shape when the baffle 10 is viewed axially. In one embodiment as illustrated in FIG. 3, the end 34 of the conical section 30 and the outer edge 24 of the back section 20 include the same outer diameter to both contact against the inner side of the suppressor tube. In one embodiment, each has an outer diameter of 1.712 inches.

Each of the first and second sides 31, 32 include a series of steps 33 to dissipate the gases that emanate from the firearm. Each step 33 includes a first side 36 and a second side 37 that intersect at a ridge 38. The steps 33 may be evenly spaced apart along one or both of the first and second sides 31, 32 of the conical section 30 as illustrated in FIG. 4, or may be unequally spaced apart. Further, each of the steps 33 may include the same shape and size as illustrated in FIG. 4, or different shapes and sizes.

Figure 5:
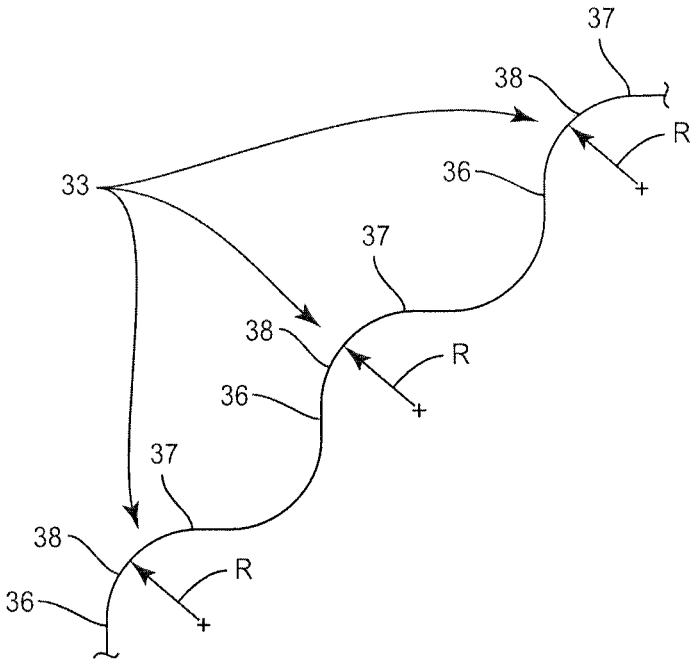
FIG. 5 is a schematic view of a series of steps on a conical section of a baffle.

FIG. 5 is a schematic view of a series of steps 33. Each step 33 includes a first riser side 36, a second tread side 37, and an intermediate ridge 38. The first and second sides 36, 37 may be arranged at various angles relative to one another. In one embodiment, the first side 36 is perpendicular to the centerline C of the bore 40. In one embodiment, the second side 37 is parallel with the centerline C. In the embodiment of FIG. 5, each of the sides 36, 37 is flat. One or both sides 36, 37 may also include different shapes and/or sizes.

The ridge 38 is formed at the intersection of the first and second sides 36, 37. The ridge 38 includes a curved shape that extends between the sides 36, 37. In one embodiment, the ridge 38 is radiused to smoothly transition between the sides 36, 37. In one specific embodiment, the radius R is 0.045 inches. The ridges 38 along the steps 33 may each be the same, or the different steps 33 may include ridges of different shapes and/or sizes. The sides 36, 37 further include valleys on opposing sides from the ridges 38. The valley may be the same shape and size of as the ridge 38, including a smooth radius. Alternatively, the valleys may include different shapes and/or sizes than the ridges.

In one embodiment, steps 33 are positioned along both the first and second sides 31, 32 as illustrated. In another embodiment, the steps 33 are positioned along just the first side 31.

The bore 40 extends through the length of the baffle 10. As illustrated in FIG. 4, the bore 40 includes a first section with a cylindrical shape that extends through the bodies of the back and conical sections 20, 30. The bore 40 also has a tapered shape through a remainder of the conical section 30 that expands towards the end 34.

Figure 6:
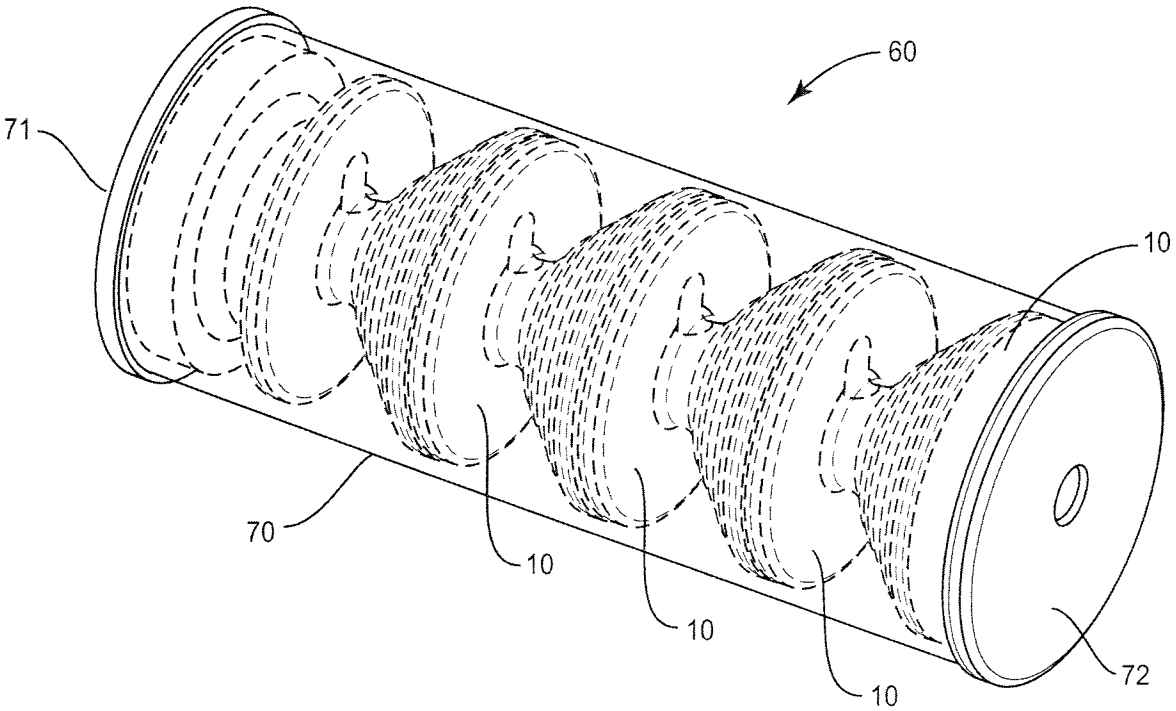
FIG. 6 is a schematic view of a sound suppressor.

FIG. 6 illustrates a suppressor 60 that includes a number of separate baffles 10. The suppressor 60 includes an exterior sleeve 70 that has a cylindrical shape. The sleeve 70 includes an open interior space and opposing ends. The sleeve 70 may be constructed from various materials, including aluminum.

A first endcap 71 is mounted at the first end of the sleeve 70 and is configured to attach to the firearm, and an opposing second endcap 72 at the second end. Each of the endcaps 71, 72 includes a bore sized to allow passage of the fired projectile. The endcaps 71, 72 may be constructed from a variety of materials. In one embodiment, the endcaps 71, 72 are constructed from aluminum. The first endcap 71 may also include a threaded insert for attachment to the firearm. In one embodiment, the insert is constructed from steel which is able to withstand the heat.

One or more baffles 10 are positioned along the interior space of the sleeve 70. The baffles 10 may include the same or different shapes and/or sizes. FIG. 6 includes each having the same shape and size. The baffles 10 are aligned with the back sections 20 positioned towards the first end of the sleeve 70 that attaches to the firearm and the conical sections 30 facing in an opposing direction. The baffles 10 are further abutted together with the end 34 of the conical section 30 of a first baffle 10 in contact against the first side 21 of the back section 20 of an adjacent baffle 10. The back section 20 and conical section 30 are further sized to contact against the inner wall of the sleeve 70. Specifically, the outer edge 24 of the back section 20 and the band 35 of the conical section 30 contact against the inner wall.

The baffles 10 may be constructed from a variety of different materials, including but not limited to aluminum and steel. In one embodiment, the first baffle (i.e., the baffle nearest to the firearm) is constructed from steel and the remaining baffles 10 are constructed from aluminum. The first steel baffle 10 may be exposed to greater amounts of heat than the other baffles 10. The aluminum baffles 10 help to reduce the overall weight of the suppressor 60.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A baffle for use in a sound suppressor for a firearm, the baffle comprising:

a back section with a first side configured to face towards the firearm and an opposing second side;

a conical section that extends outward at the second side of the back section and includes an outer side and an inner side, the conical section including a tapered shape that enlarges away from the back section;

an opening that extends through the back section and having an inlet at the first side and an outlet at the second side, a centerline of the opening being parallel with the tapered conical section;

a central bore that extends through the back section and the conical section;

steps that extend around the outer side of the conical section and along a length of the outer section, the steps facing the outlet of the opening, each of the steps including a flat riser section that extends away from the central bore, a flat tread section, and a curved intermediate portion that connects the riser and tread sections.

2. The baffle of claim 1, wherein the riser section is perpendicular with the central bore.

3. The baffle of claim 1, wherein the tread section is parallel with the central bore.

4. The baffle of claim 1, wherein a single opening extends through the back section.

5. The baffle of claim 4, wherein the opening intersects with the central bore within an interior of the back section between the first and second sides.

6. The baffle of claim 1, wherein the first side of the back section includes a concave indent that extends around the central bore.

7. The baffle of claim 1, further comprising a second series of steps that extend around and along the inner side of the conical section, each of the second series of steps includes a riser section and a tread section.

8. The baffle of claim 1, wherein each of the steps includes a common shape and size.

9. A baffle for use in a sound suppressor for a firearm, the baffle comprising:

a central bore;

a back section that extends around the central bore with a first side configured to face towards the firearm and an opposing second side;

a conical section that extends around the central bore and is integral with and extends outward from the back section along the central bore, the conical section including an inner side that faces towards the central bore and an outer side that faces away from the central bore, the conical section having a tapered shape that enlarges away from the back section;

an opening that extends through the back section with an inlet at the first side that is in communication with the central bore and an outlet at the second side, a centerline of the opening being parallel with the tapered conical section; and steps that extend along each the inner and outer sides of the conical section, each of the steps including a riser section that extends away from the central bore, a tread section, and an intermediate portion that connects the riser and tread sections.

10. The baffle of claim 9, wherein the intermediate section of each step along the outer side includes a constant radius.

11. The baffle of claim 9, wherein the riser section of each step is perpendicular with the central bore.

12. The baffle of claim 9, wherein the tread section of each step is parallel with the central bore.

13. The baffle of claim 9, wherein each of the steps along the outer side includes a common shape and size.

14. The baffle of claim 9, wherein the first side of the back section includes a concave indent that extends around the central bore.

* * * * *